US009338547B2

(12) United States Patent
Fox et al.

(10) Patent No.: US 9,338,547 B2
(45) Date of Patent: May 10, 2016

(54) METHOD FOR DENOISING AN ACOUSTIC SIGNAL FOR A MULTI-MICROPHONE AUDIO DEVICE OPERATING IN A NOISY ENVIRONMENT

(71) Applicant: PARROT, Paris (FR)

(72) Inventors: Charles Fox, Paris (FR); Guillaume Vitte, Paris (FR); Maurice Charbit, Villejuif (FR); Jacques Prado, Cherrueix (FR)

(73) Assignee: PARROT, Paris (FR)

( * ) Notice: Subject to any disclaimer, the term of this patent is extended or adjusted under 35 U.S.C. 154(b) by 273 days.

(21) Appl. No.: 13/915,298

(22) Filed: Jun. 11, 2013

(65) Prior Publication Data

US 2013/0343558 A1 Dec. 26, 2013

(30) Foreign Application Priority Data

Jun. 26, 2012 (FR) ..... 12 56049

(51) Int. Cl.
*H04R 3/00* (2006.01)
*G10L 21/0208* (2013.01)
*G10L 21/0216* (2013.01)

(52) U.S. Cl.
CPC ..... *H04R 3/002* (2013.01); *G10L 21/0208* (2013.01); *G10L 2021/02166* (2013.01)

(58) Field of Classification Search
USPC ..... 381/92, 71.1, 71.8, 73.1, 91, 122, 94.1, 381/94.2, 111, 67; 704/233, 226, E11.003, 704/205, 214
See application file for complete search history.

(56) References Cited

U.S. PATENT DOCUMENTS

2003/0040908 A1* 2/2003 Yang ..... H04R 3/005 704/233
2009/0010449 A1* 1/2009 Burnett ..... G10L 21/0208 381/92

(Continued)

FOREIGN PATENT DOCUMENTS

EP 1 640 971 A1 3/2006
WO 2008104446 A2 9/2008

OTHER PUBLICATIONS

McCowan, Iain A., Adaptive Parameter Compensation for Robust Hands-Free Speech Recognition Using a Dual Beamforming Microphone Array, Proceeding of 2001 International Symposium of Intelligent Multimedia, Video and Speech Processing, May 2-4, 2001 Hong Kong, p. 547-550.

*Primary Examiner* — Duc Nguyen
*Assistant Examiner* — Yogeshkumar Patel
(74) *Attorney, Agent, or Firm* — Haverstock & Owens LLP

(57) ABSTRACT

This method comprises steps of: a) partitioning (10, 16) the spectrum of the noisy signal into a HF part and a LF part; b) operating denoising processes in a differentiated manner for each of the two parts of the spectrum with, for the HF part, a denoising by prediction of the useful signal from one sensor to the other between sensors of a first sub-array ($R_1$), by means of a first adaptive algorithm estimator (14), and, for the LF part, a denoising by prediction of the noise from one sensor to the other between sensors of a second sub-array ($R_2$), by means of a second adaptive algorithm estimator (18); c) reconstructing the spectrum by combining together (22) the signals delivered after denoising of the two parts of the spectrum, respectively; and d) selectively reducing the noise (24) by an Optimized Modified Log-Spectral Amplitude gain, OM-LSA, process.

14 Claims, 3 Drawing Sheets

(56) References Cited

U.S. PATENT DOCUMENTS

2009/0299739 A1* 12/2009 Chan ..... H04R 3/005
704/224

2010/0278352 A1* 11/2010 Petit ..... G10L 21/0208
381/71.1

2010/0329492 A1* 12/2010 Derleth ..... G10L 21/0208
381/317

* cited by examiner (omnidirectional)

(unidirectional)

METHOD FOR DENOISING AN ACOUSTIC SIGNAL FOR A MULTI-MICROPHONE AUDIO DEVICE OPERATING IN A NOISY ENVIRONMENT

The invention relates to speech processing in noisy environment.

In particular, it relates to the processing of speech signals picked up by phone devices of the "hands-free" type, intended to be used in a noisy environment.

Such apparatuses includes one or several sensitive microphones ("mics"), picking up not only the voice of the user, but also the surrounding noise, which noise constitutes a disturbing element that, in some cases, can go as far as to make the words of the speaker unintelligible. The same goes if it is desired to implement voice recognition techniques, because it is very difficult to operate a shape recognition on words embedded in high level of noise.

This difficulty linked to the surrounding noises is particularly restricting in the case of "hands-free" devices for automotive vehicles, whether they are systems incorporated to the vehicle or accessories in the form of a removable box integrating all the signal processing components and functions for the phone communication.

Indeed, in this application, the great distance between the microphone (placed at the dashboard or in an angle of the passenger compartment roof) and the speaker (whose remoteness is limited by the driving position) leads to the picking up of a relatively high level of noise, which makes it difficult to extract the useful signal embedded in the noise. Moreover, the very noisy environment typical of automotive vehicles has spectral characteristics that evolve unpredictably as a function of the driving conditions: rolling on uneven or cobbled road surfaces, car radio in operation, etc.

Comparable difficulties exist when the device is an audio headset, of the combined microphone/headset type, used for communication functions such as "hands-free" phone functions, in supplement of the listening of an audio source (music for example) coming from an apparatus to which the headset is plugged.

In this case, the matter is to provide a sufficient intelligibility of the signal picked up by the microphone, i.e. the speech signal of the nearby speaker (the headset wearer). Now, the headset may be used in a noisy environment (metro, busy street, train, etc.), so that the microphone picks up not only the speech of the headset wearer, but also the surrounding spurious noises. The wearer is protected from this noise by the headset, in particular if it is a model with closed earphones, isolating the ear from the outside, and even more if the headset is provided with an "active noise control" function. But the remote speaker (who is at the other end of the communication channel) will suffer from the spurious noises picked up by the microphone and superimposing onto and interfering with the speech signal of the nearby speaker (the headset wearer). In particular, certain formants of the speech that are essential to the understanding of the voice are often embedded in noise components often met in the usual environments.

The invention more particularly relates to the techniques of denoising implementing an array of several microphones, by combining judiciously the signals picked up simultaneously by these microphones to discriminate the useful speech components from the spurious noise components.

A conventional technique consists in placing and orienting one of the microphones so that it mainly picks up the voice of the speaker, whereas the other is arranged in such a manner to pick up a greater noise component than the main microphone.

The comparison of the picked-up signals allows extracting the voice from the ambient noise by spatial coherence analysis of the two signals, with relatively simple software means.

The US 2008/0280653 A1 describes such a configuration, where one of the microphones (that which mainly picks up voice) is that of a wireless earphone worn by the driver of the vehicle, whereas the other (that which mainly picks up the noise) is that of the phone device, placed at a remote place in the passenger compartment of the vehicle, for example attached to the dashboard.

However, this technique has the drawback that it requires two remote microphones, wherein the efficiency is all the more high that the two microphones are remote from each other. For that reason, this technique is not applicable to a device in which the two microphones are close together, for example two microphones incorporated in the front of an automotive vehicle radio, or two microphones that would be arranged on one of the shells of a headset earphone.

Still another technique, referred to as beamforming, consists in creating through software means a directivity that improves the signal/noise ratio of the array or "antenna" of microphones. The US 2007/0165879 A1 describes such a technique, applied to a pair of non-directional microphones placed back to back. An adaptive filtering of the picked up signals allows deriving at the output a signal in which the voice component has been reinforced.

However, it is considered that a multi-sensor denoising method provides good results only if an array of at least eight microphones is available, the performances being extremely limited when only two microphones are used.

The EP 2 923 594 A1 and EP 2 309 499 A1 (Parrot) describe other techniques, also based on the hypothesis that the useful signal and/or the spurious noises have a certain directivity, which combine the signals coming from the different microphones so as to improve the signal/noise ratio as a function of these conditions of directivity. These denoising techniques are based on the hypothesis that the speech has generally a higher spatial coherence than the noise and that, moreover, the direction of incidence of the speech is generally well defined and may be supposed to be known (in the case of an automotive vehicle, it is defined by the position of the driver, toward whom the microphones are turned). However, this hypothesis takes badly into account the typical effect of reverberation of the passenger compartment of a vehicle, where the powerful and numerous reflections make it difficult to calculate a direction of arrival. They may also be placed in default by noises having a certain directivity, such as horn sounds, passage of a scooter, a vehicle overtaking, etc.

Still another method is described in the article of I. McCowan and S. Sridharan, "Adaptive Parameter Compensation for Robust Hands-free Speech Recognition using a Dual-Beamforming Microphone Array", *Proceedings on* 2001 *International Symposium on Intelligent Multimedia, Video and Speech Processing*, May 2001.

Generally, these techniques based on hypotheses of directivity all have limited performances regarding noise components located in the region of the lowest frequencies—where, precisely, the noise can be concentrated at a relatively high level of energy.

Indeed, the directivity is all the more marked that the frequency is high, so that this criterion becomes not much discriminating for the lowest frequencies. Indeed, to remain efficient enough, it is necessary to significantly space the microphones apart from each other, for example 15 to 20 cm, or even more as a function of the desired performance, so as to sufficiently decorrelate the noises picked up by these microphones.

Consequently, it is not possible to incorporate such an array of microphones for example to the casing of an automotive vehicle radio, or to a standalone "hands-free kit" box placed in the vehicle, even more on shells of earphones of a headset.

The problem of the invention is, in such a context, to have access to an efficient noise reduction technique for delivering to the remote speaker a voice signal representative of the speech emitted by the nearby speaker (the vehicle driver or the headset wearer), by clearing this signal from the spurious components of outer noise present in the environment of this nearby speaker, wherein such technique:

- has increased performances in the bottom of the frequency spectrum, where the most disturbing spurious noise components, in particular from the point of view of the speech signal masking, are the most often concentrated;
- requires only a small number of microphones (typically, no more than three to five microphones) for its implementation; and
- with a sufficiently squat geometrical configuration of the array of microphones (typically with a space of only a few centimeters between the microphones), to allow in particular its integration to compact products of the "all-in-one" type.

The starting point of the invention lies in the analysis of the typical noise field in the passenger compartment of an automotive vehicle, which leads to the following observations:

- the noise in the passenger compartment is spatially coherent in the low frequencies (below about 1000 Hz);
- it loses coherence in the high frequencies (above 1000 Hz); and
- according to the type of microphone used, unidirectional or omnidirectional, the spatial coherence is modified.

These observations, which will be clarified and justified hereinafter, lead to propose a hybrid denoising strategy, implementing in low frequency (LF) and in high frequency (HF) two different algorithms, exploiting the coherence or non-coherence of the noise components according to the part of the spectrum considered;

- the strong coherence of noises in LF allows contemplating an algorithm exploiting a prediction of the noise from one microphone to the other, which is possible due to the fact that periods of silence of the speaker, with absence of useful signal and exclusive presence of the noise, can be observed;
- on the other hand, in HF, the noise is slightly coherent and difficult to predict, except providing a high number of microphones (which is not desired) or placing the microphones closer to each other to make the noises more coherent (but a great coherence will never be obtained in this band, except merging the microphones: the picked-up signals would then be the same, and there would be no spatial information). For this HF part, an algorithm exploiting the predictable character of the useful signal from one microphone to the other (and no longer a prediction of the noise) is then used, which is possible, by hypothesis, because it is known that this useful signal is produced by a point source (the mouth of the speaker).

More precisely, the invention proposes a method for denoising a noisy acoustic signal for a multi-microphone audio device of the general type disclosed in the above-mentioned article of McCowan and S. Sridharan, wherein the device comprises an array of sensors formed of a plurality of microphone sensors arranged according to a predetermined configuration and adapted to collect the noisy signal, the sensors being grouped into two sub-arrays, with a first sub-array adapted to collect a HF part of the spectrum, and a second sub-array adapted to collect a LF part of the spectrum, distinct of the HF part.

This method comprises the following steps:

a) partitioning the spectrum of the noisy signal between said HF part and said LF part, by filtering above and below a predetermined pivot frequency, respectively, b) denoising each of the two parts of the spectrum with implementation of an adaptive algorithm estimator; and c) reconstructing the spectrum by combining together the signals delivered after denoising of the two parts of the spectrum at steps b1) and b2).

Characteristically of the invention, the step b) of denoising is operated by distinct processes for each of the two parts of the spectrum, with:

b1) for the HF part, a denoising exploiting the predictable character of the useful signal from one sensor to the other, between sensors of the first sub-array, by means of a first adaptive algorithm estimator (14), and b2) for the LF part, a denoising by prediction of the noise from one sensor to the other, between sensors of the second sub-array, by means of a second adaptive algorithm estimator (18).

As regards the geometry of the array of sensors, the first sub-array of sensors adapted to collect the HF part of the spectrum may notably comprise a linear array of at least two sensors aligned perpendicular to the direction of the speech source, and the second sub-array of sensors adapted to collect the LF part of the spectrum may comprise a linear array of at least two sensors aligned parallel to the direction of the speech source.

The sensors of the first sub-array of sensors are advantageously unidirectional sensors, oriented toward the speech source.

The denoising process of the HF part of the spectrum at step b1) may be operated in a differentiated manner for a lower band and an upper band of this HF part, with selection of different sensors among the sensors of the first sub-array, the distance between the sensors selected for the denoising of the upper band being more reduced than the distance of the sensors selected for the denoising of the lower band.

The denoising process preferably provides, after step c) of reconstruction of the spectrum, a step of:

d) selective reduction of the noise by a process of the Optimized Modified Log-Spectral Amplitude, OM-LSA, gain type, from the reconstructed signal produced at step c) and a speech presence probability.

As regards the denoising of the HF part of the spectrum, the step b1), exploiting the predictable character of the useful signal from one sensor to the other, may be operated in the frequency domain, in particular by:

b11) estimating a speech presence probability in the collected noisy signal;

b12) estimating a spectral covariance matrix of the noises collected by the sensors of the first sub-array, this estimation being modulated by the speech presence probability;

b13) estimating the transfer function of the acoustic channels between the source of speech and at least certain of the sensors of the first sub-array, this estimation being operated with respect to a reference of useful signal consisted by the signal collected by one of the sensors of the first sub-array, and being further modulated by the speech presence probability; and b14) calculating, in particular by an estimator of the Minimum Variance Distortionless Response, MVDR, beamforming type, an optimal linear projector giving a single denoised combined signal based on the signals collected by at least certain of the sensors of the first sub-array, on the spectral covariance matrix estimated at step b12), and on the transfer functions estimated at step b13).

The step b13) of estimating the transfer function of the acoustic channels may notably be implemented by an linear prediction adaptive filter, of the Least Mean Square, LMS, type, with a modulation by the speech presence probability, in particular a modulation by variation of the iteration pitch of the LMS adaptive filter.

For the denoising of the LF part at step b2), the prediction of the noise from one sensor to the other may be operated in the time domain f, in particular by a filter of the Speech Distortion Weighting Multi-channel Wiener Filter, SDW-MWF, type, in particular a SDW-MWF filter adaptively estimated by a gradient descending algorithm.

An exemplary embodiment of the device of the invention will now be described, with reference to the appended drawings in which same reference numbers designate identical or functionally similar elements throughout the figures.

FIG. 1 schematically illustrates an example of array of microphones, comprising four microphones selectively usable for implementing the invention.

FIGS. 2*a* and 2*b* are characteristic curves, for an omnidirectional microphone and a unidirectional microphone, respectively, showing the variations, as a function of the frequency, of the correlation (squared coherence function) between two microphones for a diffuse noise field, for several values of distance between these two microphones.

An example of denoising technique implementing the teachings of the invention will now be described in detail.

Configuration of the Array of Microphone Sensors

Figure 1:
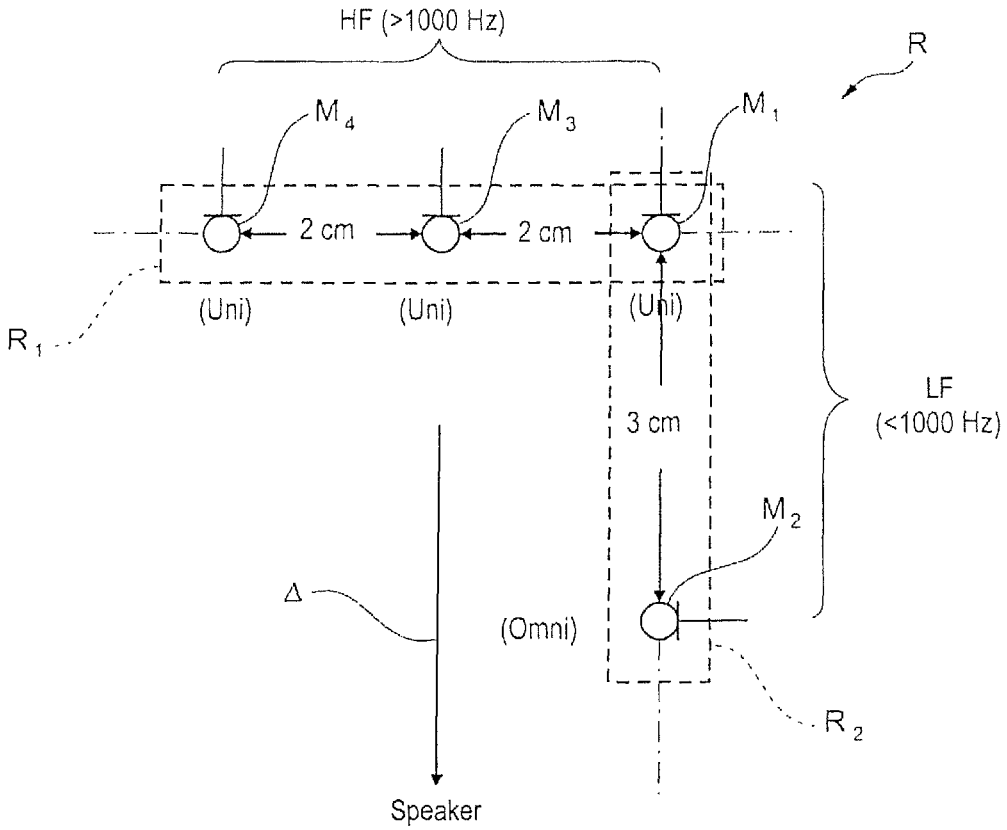

As illustrated in FIG. 1, an array R of microphone sensors $M_1 \ldots M_4$ will be considered, wherein each sensor can be liken to a single microphone picking up a noisy version of an speech signal emitted by a source of useful signal (speaker) of direction of incidence Δ.

Each microphone thus picks up a component of the useful signal (the speech signal) and a component of the surrounding spurious noise, in all its forms (directive or diffuse, stationary or evolving in an unpredictable manner, etc.).

The array R is configured as two sub-arrays $R_1$ and $R_2$ dedicated to picking up and processing the signals in the upper part (hereinafter "high frequency", HF) of the spectrum and in the lower part (hereinafter "low frequency", LF) of this same spectrum.

The sub-array $R_1$ dedicated to the HF part of the spectrum is consisted of the three microphones $M_1$, $M_3$, $M_4$, which are aligned perpendicular to the direction of incidence Δ, with a respective space of d=2 cm, in the illustrated example. These microphones are preferably unidirectional microphones, whose main lobe is oriented in the direction Δ of the speaker.

The under-array $R_2$ dedicated to the LF part of the spectrum is consisted of the two microphones $M_1$ and $M_2$, aligned parallel to the direction A and spaced apart by d=3 cm in the illustrated example. It will be noted that the microphone $M_1$, which belongs to the two sub-arrays $R_1$ and $R_2$, is mutualized, which allows reducing the total number of microphones of the array. This mutualization is advantageous but is however not necessary. On the other hand, a "L"-shaped configuration has been illustrated, in which the mutualized microphone is the microphone $M_1$, but this configuration is not restrictive, and the mutualized microphone can be for example the microphone $M_3$, given to the whole array a "T"-shaped configuration.

Besides, the microphone $M_2$ of the LF array may be an omnidirectional microphone, insofar as the directivity is far less marked in LF than in HF.

Finally, the illustrated configuration showing two sub-arrays $R_1$+$R_2$ comprising 3+2 microphones (i.e. a total of 4 microphones, taking into account the mutualization of one of the microphones) is not limitative. The minimal configuration is a configuration with 2+2 microphones (i.e. a minimum of 3 microphones if one of them is mutualized). Conversely, it is possible to increase the number of microphones, with configurations of 4+2 microphones, 4+3 microphones, etc.

The increase of the number of microphones allows, in particular in the high frequencies, selecting different configurations of microphones according to the parts of the HF spectrum that are processed.

Therefore, in the illustrated example, if operating in wideband telephony with a frequency range going up to 8000 Hz (instead of 4000 Hz), for the lower band (1000 to 4000 Hz) of the HF part of the spectrum, the two extreme microphones $\{M_1, M_4\}$, spaced apart from each other by d=4 cm, will be chosen, whereas for the upper band (4000 to 8000 Hz) of this same HF part, a couple of two neighboring microphones $\{M_1, M_3\}$ or $\{M_3, M_4\}$, or the three microphones $\{M_1, M_3, M_4\}$ together, will be used, such microphones being spaced apart from each other by d=2 cm only: it is therefore benefited, in the lower band of the HF spectrum, from the maximum space between the microphones, which maximizes the decorrelation of the picked-up noises, while avoiding in the upper band an aliasing of the high frequencies of the signal to be rendered; such an aliasing would otherwise appear due to a too low spatial sampling frequency, insofar as the maximum phase lag picked up by the microphone, then by the other, has to be lower than the sampling period of the signal digitalization converter.

The way to choose the pivot frequency between the two LF and HF parts of the spectrum, and the preferential choice of unidirectional/omnidirectional type of microphone according to the part of the spectrum to be processed, HF or LF, will now be described with reference to FIGS. 2*a* and 2*b*.

Figure 2A:
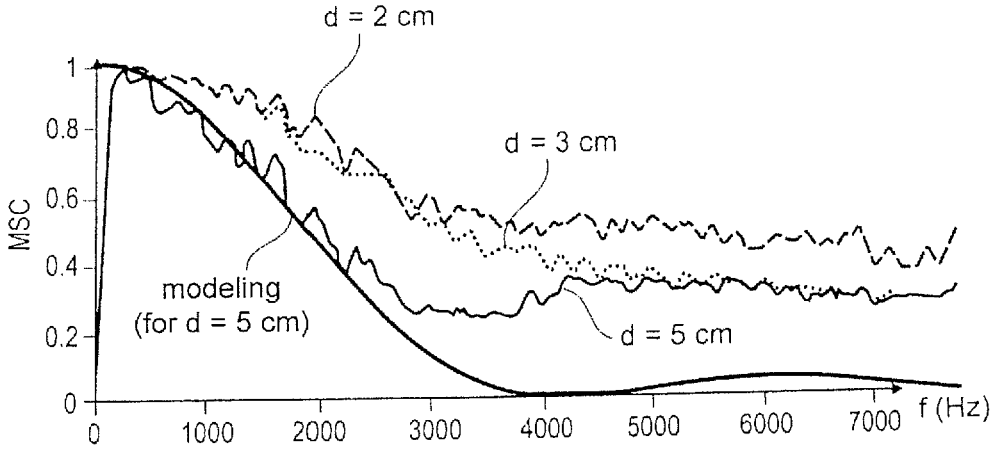
Figure 2B:
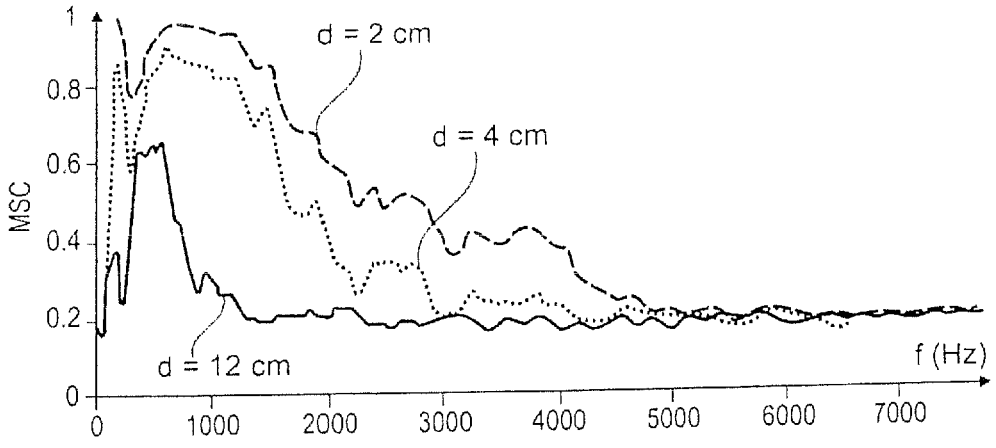

These FIGS. 2*a* and 2*b* illustrate, for an omnidirectional microphone and a unidirectional microphone, respectively, characteristic curves giving, as a function of the frequency, the value of the function of correction between two microphones, for several values of space d between these two microphones.

The function of correlation between two microphones spaced apart by a distance d, for a diffuse noise field model, is a generally decreasing function of the distance between the microphones. This correlation function is represented by the Mean Squared Coherence (MSC), which varies between 1 (the two signals are perfectly coherent, they differ by only one linear filter) and 0 (fully decorrelated signals). In the case of an omnidirectional microphone, this coherence may be modeled as a function of the frequency, by the following function:

$$MSC(f) = \left|\frac{\sin(2\pi f \tau)}{2\pi f \tau}\right|^2$$

f being the frequency considered and τ being the propagation lag between the microphones, i.e. τ=d/c, where d is the distance between the microphones and c is the speed of sound.

This modeled curve has been illustrated in FIG. 2*a*, with FIGS. 2*a* and 2*b* also showing the coherence function MSC really measured for the two types of microphones and for various values of distance d.

If we consider that the signals are effectively coherent when the value of MSC>0.9, the noise can be considered as being coherent when we are below a frequency $f_0$ such that:

$$f_0 = \frac{0.787c}{2\pi d}.$$

This gives a pivot frequency $f_0$ of about 1000 Hz for microphones spaced apart by d=4 cm (distance between the microphones $M_1$ and $M_4$ of the example of array of FIG. 1).

In the present example, corresponding in particular to the array of microphones having the dimensions described hereinabove, a pivot frequency $f_0$=1000 Hz will thus be chosen, below which (LF part) it will be considered that the noise is coherent, which allows contemplating an algorithm based on a prediction of this noise from one microphone to the other (prediction operated during the periods of silence of the speaker, where only the noise is present).

Preferably, unidirectional microphones will be used for this LF part, because, as can be seen by comparing the FIGS. 2*a* and 2*b*, the variation of the coherence function is far more abrupt in this case than with an omnidirectional microphone.

In the HF part of the spectrum, where the noise is slightly coherent, it is no longer possible to predict this noise in a satisfying manner; another algorithm will then be implemented, which exploits the predictable character of the useful signal (and no longer of the noise) from one microphone to the other.

Finally, it will be noted that the choice of the pivot frequency ($f_0$=1000 Hz for d=2 cm) also depends on the space between the microphones, a larger space corresponding to a lower pivot frequency, and vice versa.

Denoising Process: Description of a Preferential Mode

A preferential embodiment of denoising of the signals collected by the array of microphones of FIG. 1 will now be described, with reference to FIG. 3, of course in a non-limitative way.

As explained hereinabove, different processing operations are performed for the top of the spectrum (high frequencies, HF) and for the bottom of the spectrum (low frequencies, LF).

For the top of the spectrum, a HF high-pass filter 10 receives the signals of the microphones $M_1$, $M_3$ and $M_4$ of the sub-array $R_1$, used jointly. These signals are firstly subjected to a fast Fourier transform FFT (block 12), then to a processing, in the frequency domain, by an algorithm (block 14) exploiting the predictable character of the useful signal from one microphone to the other, in this example an estimator of the MMSE-STSA (Minimum Mean-Squared Error Short-Time Spectral Amplitude) type, which will be described in detail hereinafter.

For the bottom of the spectrum, a LF low-pass filter 16 receives as an input the signals picked up by the microphones $M_1$ and $M_2$ of the sub-array $R_2$. These signals are subjected to a denoising process (bloc 18) operated in the time domain by an algorithm exploiting a prediction of the noise from one microphone to the other during the periods of silence of the speaker. In this example, an algorithm of the SDW-MWF (Speech Distortion Weighted Multichannel Wiener Filter) type is used, which will be described in detail hereinafter. The resulting denoised signal is then subjected to a fast Fourier transform FFT (block 20).

Two resulting mono-channel signals, one for the HF part coming from the block 14 and the other for the LF part coming from the block 18 after a switch to the frequency domain by the block 20, are thus obtained, from two multi-channel processing operations.

These two resulting denoised signals are combined (block 22) so as to operate a reconstruction of the complete spectrum, HF+LF.

Very advantageously, an additional (mono-channel) process of selective denoising (block 24) is operated on the corresponding reconstructed signal. The signal produced by this process is finally subjected to an inverse fast Fourier transform iFFT (block 26) to switch back to the time domain.

More precisely, this final selective denoising process consists in applying a variable gain peculiar to each frequency band, this denoising being also modulated by a speech presence probability.

It also advantageously possible to use for the denoising of the block 24 a method of the OM/LSA (Optimally Modified—Log-Spectral Amplitude) type, as described by:

[1] I. Cohen, "Optimal Speech Enhancement under Signal Presence Uncertainty Using Log-Spectral Amplitude Estimator", *Signal Processing Letters, IEEE*, Vol. 9, No 4, pp. 113-116, April 2002.

Essentially, the application of a gain called "LSA gain" (for Log-Spectral Amplitude) allows minimizing the mean squared distance between the logarithm of the amplitude of the estimated signal and the logarithm of the amplitude of the original speech signal. This second criterion proves to be higher than the first one because the chosen distance is in better keeping with the behavior of the human ear and thus gives qualitatively better results.

In all the cases, the matter is to reduce the energy of the very noisy frequency components by applying to them a low gain, while leaving intact (by applying a gain equal to 1) those which are not much noisy or not noisy at all.

The "OM-LSA" (Optimally-Modified LSA) algorithm improves the calculation of the LSA gain to be applied by weighting it with a conditional Speech Presence Probability SPP, which occurs at two levels:

- for the estimation of the noise energy: the probability modulates the forgetting factor toward a faster updating of the noise estimation on the noisy signal when the speech presence probability is low;
- for the calculation of the final gain: the noise reduction applied is all the more high (i.e. the gain applied is all the more low) that the speech presence probability is low.

The speech presence probability SPP is a parameter that can take several different values comprised between 0 and 100%. This parameter is calculated according to a technique known per se, examples of which are notably exposed in:

[2] I. Cohen et B. Berdugo, "Two-Channel Signal Detection and Speech Enhancement Based on the Transient Beam-to-Reference Ratio", *IEEE International Conference on Acoustics, Speech and Signal Processing ICASSP* 2003, Hong-Kong, pp. 233-236, April 2003.

It may also be referred to the WO 2007/099222 A1 (Parrot), which describes a denoising technique implementing a calculation of speech presence probability.

HF Denoising MMSE-STSA Algorithm (Block 14)

An example of denoising process applied to the HF part of the spectrum by a MMSE-STSA estimator operating in the frequency domain will now be described.

This particular implementation is of course not limitative, and other denoising techniques can be contemplated, from the moment that they are based on the predictable character of the useful signal from one microphone to the other. Furthermore, this HF denoising is not necessarily operated in the frequency domain, but may also be operated in the time domain, by equivalent means.

The technique proposed consists in searching for an optimal linear "projector" for each frequency, i.e. an operator corresponding to a transformation of a plurality of signals (those collected concurrently by the various microphones of the sub-array $R_1$) into a single mono-channel signal.

This projection, estimated by the block 28, is an "optimal" linear projection in that it is tried to do so that the residual noise component on the mono-channel signal delivered as an output is minimized and the useful speech component is as little deformed as possible.

This optimization involves searching, for each frequency, for a vector A such that:

- the projection $A^T X$ contains as little noise as possible, i.e. the power of the residual noise, that is equal to $E[A^T V V^T A]=A^T R_n A$, is minimized, and
- the voice of the speaker is not deformed, which results in the constraint $A^T H=1$, where $R_n$ is the correlation matrix between the microphones, for each frequency, and H is the acoustic channel considered.

This problem is a problem of optimization under constraint, i.e. the search for $\min(A^T R_n A)$ under the constraint $A^T H=1$.

It may be solved using the method of the Lagrange multipliers, which leads to the solution:

$$A^T = \frac{H^T R_n^{-1}}{H^T R_n^{-1} H}.$$

In the case where the transfer functions H correspond to a pure delay, the formula of the MVDR (Minimum Variance Distorsionless Response) beamforming, also referred to as Capon beamforming is recognized. It is to be noted that the residual noise power is equal, after projection, to $$\frac{1}{H^T R_n^{-1} H}.$$

Moreover, if estimators of the MMSE (Minimum Mean-Squared Error) type on the signal amplitude and phase at each frequency is considered, it is observed that these estimators are written as a Capon beamforming followed with a selective mono-channel denoising process, as exposed by:

[3] R. C. Hendriks et al., *On optimal multichannel mean-squared error estimators for speech enhancement*, IEEE Signal Processing Letters, vol. 16, no. 10, 2009.

The selective noise denoising process, applied to the mono-channel signal resulting from the beamforming process, is advantageously the OM-LSA type process described hereinabove, operated by the bloc 24 on the complete spectrum after synthesis at 22.

The noise interspectral matrix is recursively estimated (block 32), using the speech presence probability SPP (block 34, see hereinabove):

$$\Sigma_{bb}(t)=\alpha\Sigma_{bb}(t-1)+(1-\alpha)X(t)X(t)^T$$

$$\alpha=\alpha_0+(1-\alpha_0)SPP$$

where $\alpha_0$ is a forgetting factor.

As regards the MVDR estimator (block 28), its implementation implies an estimation of the acoustic transfer functions $H_i$ between the source of speech and each of the microphones $M_i$ ($M_1$, $M_3$ or $M_4$).

These transfer functions are advantageously evaluated by an estimator of the frequency LMS type (block 30) receiving as an input the signals coming from the different microphones and delivering as an output the estimates of the various transfer functions H.

It is also necessary to estimate (block 32) the correlation matrix $R_n$ (spectral covariance matrix, also called noise interspectral matrix).

Finally, these various estimations imply knowing a speech presence probability SPP, obtained from the signal collected by one of the microphones (block 34).

The way the MMSE-STSA estimator operates will now be described in detail.

The matter is to process the multiple signals produced by the microphones to provide a single denoised signal that is the nearest possible to the speech signal emitted by the speaker, i.e.:

- containing as little noise as possible, and
- deforming as little as possible the voice of the speaker reproduced as an output.

On the microphone of rank i, the signal collected is:

$$x_i(t)=h_i \otimes (t)+b_i(t)$$

where $x_i$ is the picked-up signal, $h_i$ is the pulse response between the source of useful signal (speech signal of the speaker) and the microphone $M_i$, s is the useful signal produced by the source S and $b_i$ is the additive signal.

For all the microphones, the vector notation may be used:

$$x(t)=t \otimes (t)+b(t)$$

In the frequency domain, this expression becomes (wherein the majuscules represent the corresponding Fourier transforms):

$$X_i(\omega)=H_i(\omega)S(\omega)+B_i(\omega)$$

The following hypotheses are made, for all the frequencies ω:

- the signal S(ω) is Gaussian with a zero mean value and a spectral power of $\sigma_s$ (ω;
- the noises $B_i$(ω are Gaussian with a zero mean value and have an interspectral matrix ($E[BB^T]$) designated by $\Sigma_{bb}(\omega)$;
- the signal and the considered noises are decorrelated, and each one is decorrelated when the frequencies are different.

As explained hereinabove, in the multi-microphone case, the MMSE-STSA estimator is factorized into a MVDR beamforming (block 28), followed with a mono-channel estimator (the OM/LSA algorithm of block 24). The MVDR beamforming is written as:

$$MVDR(X) = \frac{H^T \sum_{bb}^{-1} X}{H^T \sum_{bb}^{-1} H}$$

The adaptive MVDR beamforming thus exploits the coherence of the useful signal to estimate a transfer function H corresponding to the acoustic channel between the speaker and each of the microphones of the sub-array.

For the estimation of this acoustic channel, an algorithm is used, of the LMD-block type in the frequency domain (block 30), such as that described notably by:

[4] J. Prado and E. Moulines, *Frequency-Domain Adaptive Filtering with Applications to Acoustic Echo Cancellation*, Springer, Ed. Annals of Telecommunications, 1994.

The algorithms of the LMS type—or NLMS (Normalized LMS) type, which is a normalized version of the LMS—are algorithms that are relatively simple and not much demanding in terms of calculation resources. For a beamforming of the GSC (Generalized Sidelobe Canceller) type, this approach is similar to that proposed by:

[5] M.-S. Choi, C.-H. Baik, Y.-C. Park, and H.-G. Kang, "A Soft-Decision Adaptation Mode Controller for an Efficient Frequency-Domain Generalized Sidelobe Canceller," *IEEE International Conference on Acoustics, Speech and Signal Processing ICASSP* 2007, Vol. 4, April 2007, pp. IV-893-IV-896.

The useful signal s(t) being unknown, H can be identified only to within a transfer function. Therefore, one of the channels is chosen as a useful signal reference, for example the channel of the microphone $M_1$, and the transfer functions $H_2 \ldots H_n$ for the other channels (which amounts to force $H_1=1$) are calculated. If the chosen reference microphone does not produce a major degradation of the useful signal, this choice has no notable influence on the performance of the algorithm.

As illustrated in the figure, the LMS algorithm aims (in a known manner) to estimate a filter H (block 36) by means of an adaptive algorithm, corresponding to the signal $x_i$ delivered by the microphone $M_1$, by estimating the voice transfer between the microphone $M_i$ and the microphone $M_1$ (taken as a reference). The output of the filter 36 is subtracted, at 38, from the signal $x_1$ picked up by the microphone $M_1$, to give a prediction error signal allowing the iterative adaptation of the filter 36. It is therefore possible to predict from the signal $x_i$ the speech component contained in the signal $x_1$. To avoid the problems linked to the causality (i.e. to be sure that the signals $x_i$ arrive in advance with respect to the reference $x_1$), the signal $x_1$ is slightly delayed (block 40).

Moreover, the error signal of the adaptive filter 36 is weighted, at 42, by the speech presence probability SPP delivered at the output of the block 34, so as to perform the filter adaptation only when the speech presence probability is high.

This weighting may notably be operated by modification of the adaptation pitch of the algorithm, as a function of the probability SPP.

The updated equation of the adaptive filter is, for the frequency bin k and for the microphone i:

$$H_i(t,k) = H_i(t-1,k) + \mu X_1(t,k) * (X_1(t,k) - H_i(t-1,k) X_i(t,k))$$

$$\text{with: } \mu = \mu_0 \frac{SPP(t,k)}{E[|X_1(k)|^2]}$$

t being the time index of the current frame, $\mu_0$ being a constant that is chosen experimentally, and SPP being the speech presence probability a posteriori, estimated as indicated hereinabove (block 34).

The adaptation pitch μ of the algorithm, modulated by the speech presence probability SPP, is written in a normalized form of the LMS (the denominator corresponding to the spectral power of the signal $x_1$ at the considered frequency):

$$\mu = \frac{p}{E[X_1^2]}$$

The hypothesis that the noises are decorrelated leads to a prediction of the voice, and not of the noise, by the LMS algorithm, so that the estimated transfer function corresponds effectively to the acoustic channel H between the speaker and the microphones.

LF Denoising DSW-MWF Algorithm (Block 18)

An example of denoising algorithm of the SDW-MWF type, operated in the time domain, will now be described, but this choice is not limitative, and other denoising techniques can be contemplated, from the moment that they are based on the prediction of a noise from one microphone to the other. Furthermore, this LF denoising is not necessarily operated in the time domain, it may also be operated in the frequency domain, by equivalent means.

The technique used by the invention is based on a prediction of the noise from a microphone to the other described, for a hearing aid, by:

[6] A. Spriet, M. Moonen, and J. Wouters, "Stochastic Gradient-Based Implementation of Spatially Preprocessed Speech Distortion Weighted Multichannel Wiener Filtering for Noise Reduction in Hearing Aids," *IEEE Transactions on Signal Processing*, Vol. 53, pp. 911-925, March 2005.

Each microphone picks up a useful signal component and a noise component. For the microphone of rank i: $x_i(t)=h_i(t)+b_i(t)$, $s_i$ being the useful signal component and $b_i$ the noise component. If it is desired to estimate a version of the useful signal present on a microphone k by a linear least mean square estimator, it amounts to estimate a filter W of size M.L, such that:

$$\hat{W}_k = \min_w E\left[|s_k(t) - w^T x(t)|^2\right]$$

where:

$x_i(t)$ is the vector $[x_i(t-L+1) \ldots x_i(t)]^T$ and $x(t)=[x_1(t)^T\, x_2(t)^T\, x_M(t)]^T$.

The solution is given by the Wiener filter:

$$\hat{W}_k = [E[x(t)x(t)^T]]^{-1} E[x(t)s_k(t)]$$

Insofar as, as explained in introduction, for the LF part of the spectrum, it is searched to estimate the noise and no longer the useful signal, it is obtained:

$$\hat{W}_k^b = \min_w E\left[|b_k(t) - w^T x(t)|^2\right]$$

This prediction of the noise present on a microphone is operated based on the noise present on all the considered microphones of the second sub-array $R_2$, and this in the period of silence of the speaker, where only the noise is present.

The technique used is similar to that of the ANC (Adaptive Noise Cancellation) denoising, using several microphones for the prediction and including in the filtering a reference microphone (for example, the microphone $M_1$).

The ANC technique is notably exposed by:

[7] B. Widrow, J. Glover, J. R., J. McCool, J. Kaunitz, C. Williams, R. Hearn, J. Zeidler, J. Eugene Dong, and R. Goodlin, "Adaptive Noise Cancelling: Principles and applications," Proceedings of the IEEE, Vol. 63, No. 12, pp. 1692-1716, Dec. 1975.

Figure 3:
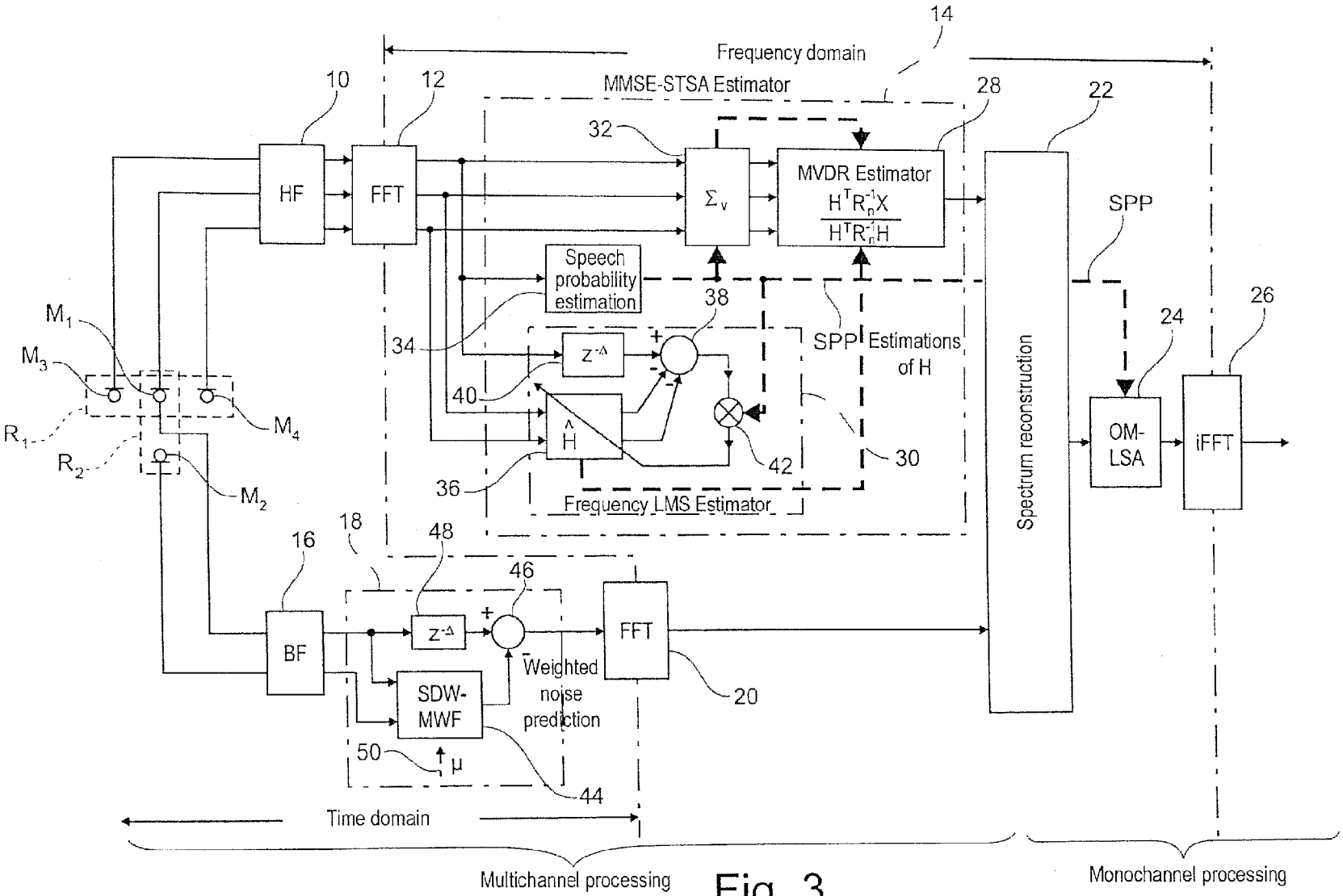
FIG. 3 is an overall diagram, in the form of functional blocks, showing the different processing operations according to the invention for denoising the signals collected by the array of microphones of FIG. 1.

As illustrated in FIG. 3, the Wiener filter (block 44) provides a noise prediction that is subtracted, at 46, from the collected signal, which is not denoised, after application of a delay (block 48) to avoid the causality problems. The Wiener filter 44 is parameterized by a coefficient μ (schematized at 50), which determines an adjustable weighting between, on the one hand, the distortion introduced by the processing of the denoised voice signal, and on the other hand, the level of residual noise.

Figure 4:
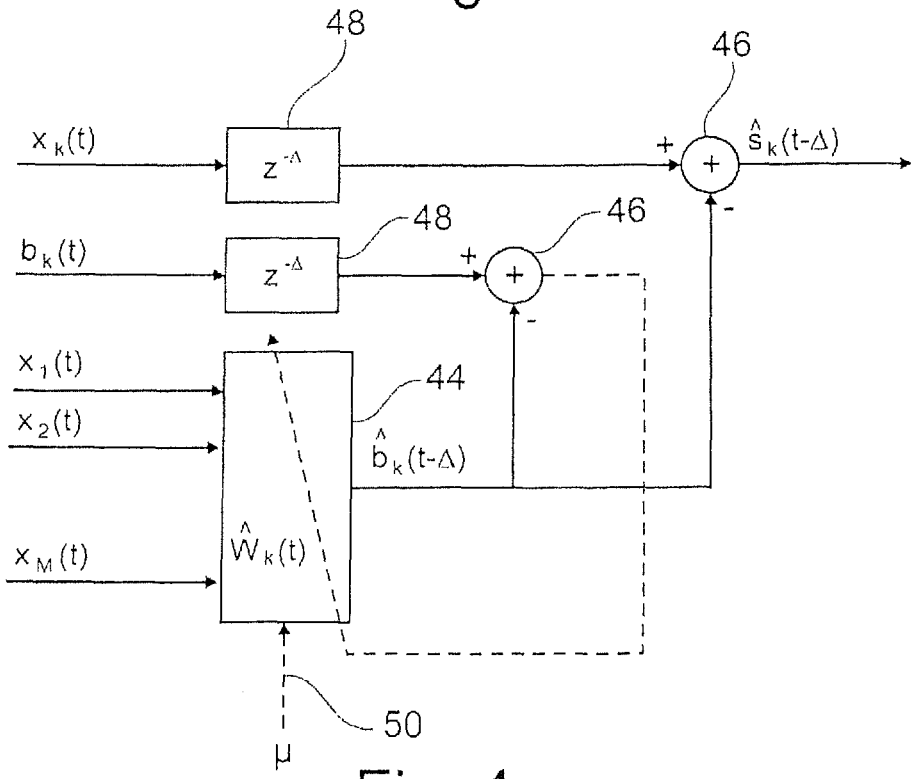
FIG. 4 is a schematic representation by functional blocks, generalized to a number of microphones higher than two, of an adaptive filter for estimating the transfer function of an acoustic channel, usable for the denoising process of the LF part of the spectrum in the overall process of FIG. 3.

In the case of a signal collected by a greater number of microphones, the generalization of this scheme of weighted noise prediction is given in FIG. 4.

The estimated signal being:

$$\hat{s}(t)=x_k(t)-\hat{W}_k^{b^T}x(t)$$

the solution is given, in the same way as previously, by the Wiener filter:

$$\hat{W}_k^b=[E[x(t)x(t)^T]]^{-1}E[x(t)b_k(t)]$$

The estimated signal is then rigorously the same, because it can be demonstrated that $$\hat{W}_k+\hat{W}_k^b=e_k,$$

$$\text{with } e_k=\left[0\ 0\ldots\underbrace{1}_{\text{position } k}\ldots 0\right]^T$$

The Wiener filter used is advantageously un weighted Wiener filter (SDWMVF), to take into account not only the energy of the noise to be eliminated by filtering, but also the distortion introduced by this filtering and which it is advisable to minimize.

In the case of a Wiener filter $\hat{W}_k$, the "cost function" may be split in two, wherein the mean square deviation can be written as the sum of the two terms:

$$E\left[|s_k(t)-w^Tx(t)|^2\right]=\underbrace{E\left[|s_k(t)-w^Ts(t)|^2\right]}_{e_s}+\underbrace{E\left[|w^Tb(t)|^2\right]}_{e_b}$$

where:

$s_i(t)$ is the vector $[s_i(t-L+1)\ldots s_i(t)]^T$ $s(t)=[s_1(t)^T\ s_2(t)^T\ldots s_M(t)^T]^T$ $b_i(t)$ is the vector $[b_i(t-L+1)\ldots s_i(t)]^T$, and $b(t)=[b_1(t)^T\ b_2(t)^T\ldots b_M(t)^T]^T$ $e_s$ is the distortion introduced by the filtering of the useful signal, and $e_b$ is the residual noise after filtering.

It is possible to weight these two errors $e_s$ and $e_b$ according to whether it is the reduction of distortion or the reduction of the residual noise that is favored.

By referring to the decorrelation between the noise and the useful signal, the problem becomes:

$$\hat{W}_{kr}=\min_w\left[E\left[|s_k(t)-w^Ts(t)|^2\right]\right]+\left[\mu E\left[|w^Tb(t)|^2\right]\right]$$

with for solution:

$$\hat{W}_{kr}=[E[s(t)s(t)^T]+\mu E[b(t)b(t)^T]]^{-1}E[s(t)s_k(t)]$$

wherein the index "$_r$" indicates that the cost function is regulated to weight according to the distortion, and μ being an adjustable parameter:

- the higher is μ, the more the reduction of the noise is favored, but at the cost of a higher distortion to the useful signal;
- if μ is null, no importance is attached to the reduction of noise, and the output is equal to $x_k(t)$ because the coefficients of the filter are null;
- if μ is infinite, the coefficients of the filter are null, except the term at the position k*L (L being the length of the filter), which is equal to 1, the output is thus equal to zero.

For the dual filter $W_k^b$, the problem may be rewritten as:

$$\hat{W}_{kr}^b=\min_w\mu\left[E\left[|b_k(t)-w^Tb(t)|^2\right]\right]+\left[E\left[|w^Ts(t)|^2\right]\right]$$

with for solution:

$$\hat{W}_{kr}^b=\left[\frac{1}{\mu}E[s(t)s(t)^T]+E[b(t)b(t)^T]\right]^{-1}E[b(t)b_k(t)]$$

It is also demonstrated that the output signal is the same, whatever the approach used.

This filter is adaptively implemented, by a gradient descending algorithm such as that described in the above-mentioned article [6].

The scheme used is illustrated in FIGS. 3 and 4.

For the implementation of this filter, it is necessary to estimate the matrices $R_s=E[s(t)s(t)^T]$, $R_b=E[b(t)b(t)^T]$, the vector $E[b(t)b_k(t)]$ as well as the parameters L (desired length of the filter) and μ (which adjusts the weighting between noise reduction and distortion).

If it is supposed that a voice activity detector is available (which allows discriminating between phases of the speaker speech and phases of the silence) and that the noise b(t) is stationary, $R_b$ may be estimated during the phases of silence, where only the noise is picked up by the micros. During these phases of silence, the matrix $R_b$ is estimated with the stream:

$$R_b(t)=\begin{cases}\lambda_b(t-1)+(1-\lambda)x(t)x(t)^T & \text{if there is no speech}\\ R_b(t-1) & \text{otherwise}\end{cases}$$

λ being a forgetting factor.

It is possible to estimate $E[b(t)b_k(t)]$, or to observe that it is a column of $R_b$. To estimate $R_s$, it is referred to the decorrelation of the noise and the useful signal. If it is denoted $R_x=E[x(t)x(t)^T]$, it is possible to write: $R_x=R_s+R_b$.

$R_x$ may be estimated in the same way as $R_b$, but with no condition on the presence of speech:

$$R_x(t)=\lambda R_x(t-1)+1-\lambda)x(t)x(t)^T$$

which allows deducing $R_x(t)=R_x(t)-R_b(t)$.

Regarding the length L of the filter, this parameter has to correspond to a spatial and temporal reality, with a sufficient number of coefficients to predict the noise temporally (time coherence of the noise) and spatially (spatial transfer between the microphones).

The parameter μ is adjusted experimentally, by increasing it until the distortion on the voice becomes perceptible by the ear.

These estimators are used to operate a gradient descending on the following cost function:

$$J_{kr}=\mu[E[|b_k(t)-w^T b(t)|^2]]+[E[|w^T s(t)|^2]]$$

The gradient of this function is equal to:

$$\delta J_{kr}=2[R_s+\mu R_b]w-2\mu E[b(t)b_k(t)]$$

Hence, the updated equation:

$$w(t)=w(t-1)-\alpha\delta J_{kr}.$$

where α is an adaptation pitch proportional to $$\frac{1}{x^T x}.$$

The invention claimed is:

1. A method for denoising a noisy acoustic signal for a multi-microphone audio device operating in a noisy environment, the noisy acoustic signal comprising a useful component coming from a source of speech and a spurious noise component, said device comprising an array of sensors formed of a plurality of microphone sensors (M1 . . . M4) arranged according to a predetermined configuration and adapted to collect the noisy signal, the sensors being grouped into two sub-arrays, with a first sub-array (R1) of sensors adapted to collect a high frequency part of the spectrum, and a second sub-array (R2) adapted to collect a low frequency part of the spectrum, distinct of said high frequency part, said method comprising:

a) partitioning the spectrum of the noisy signal into said high frequency part (HF) and said low frequency part (LF), by filtering (10, 16) above and below a predetermined pivot frequency, respectively, b) denoising each of the two parts of the spectrum with implementation of an adaptive algorithm estimator; and c) reconstructing the spectrum by combining (22) together the signals delivered after denoising of the two parts of the spectrum at steps b1 ) and b2), the method being characterized in that the step b) of denoising is operated by distinct processes for each of the two parts of the spectrum, with:

b1) for the high frequency part, a denoising exploiting the predictable character of the useful component from one sensor to the other, between sensors of the first sub-array, by means of a first adaptive algorithm estimator (14) including calculation of an optimal linear projector, and b2) for the low frequency part, a denoising by prediction of the spurious noise component from one sensor to the other, between sensors of the second sub-array, by means of a second adaptive algorithm estimator (18) including a linear prediction adaptive filter.

2. The method of claim 1, wherein the first sub-array of sensors (R1) adapted to collect the high frequency part of the spectrum comprises a linear array of at least two sensors (M1, M3, M4) aligned perpendicular to the direction (Δ) of the speech source.

3. The method of claim 1, wherein the second sub-array of sensors (R2) adapted to collect the low frequency part of the spectrum comprises a linear array of at least two sensors (M1, M2) aligned parallel to the direction (A) of the speech source.

4. The method of claim 2, wherein the sensors (M1, M3, M4) of the first sub-array of sensors (R1) are unidirectional sensors oriented in the direction (Δ) of the speech source.

5. The method of claim 2, wherein the denoising process of the high frequency part of the spectrum at step b1) may be operated in a differentiated manner for a lower band and an upper band of this high frequency part, with selection of different sensors among the sensors of the first sub-array (R1), the distance between the sensors (M1, M4) selected for the denoising of the upper band being more reduced than that of the sensors (M3, M4) selected for the denoising of the lower band.

6. The method of claim 1, further comprising, after step c) of reconstruction of the spectrum, a step of:

d) selective reduction of the noise (24) by a process of the Optimized Modified Log-Spectral Amplitude, OM-LSA, gain type, from the reconstructed signal produced at step c) and a speech presence probability.

7. The method of claim 1, wherein the step b1) of denoising of the high frequency part, exploiting the predictable character of the useful signal from one sensor to the other, is operated in the frequency domain.

8. The method of claim 7, wherein the step b1) of denoising of the high frequency part, exploiting the predictable character of the useful signal from one sensor to the other, is operated by:

b11) estimating (34) a speech presence probability (SPP) in the collected noisy signal;

b12) estimating (32) a spectral covariance matrix of the noises collected by the sensors of the first sub-array, this estimation being modulated by the speech presence probability;

b13) estimating (30) the transfer function of the acoustic channels between the source of speech and at least certain of the sensors of the first sub-array, this estimation being operated with respect to a reference of useful signal consisted by the signal collected by one of the sensors of the first sub-array, and being further modulated by the speech presence probability; and b14) calculating (28) an optimal linear projector giving a single denoised combined signal based on the signals collected by at least certain of the sensors of the first sub-array, on the spectral covariance matrix estimated at step b12), and on the transfer functions estimated at step b13).

9. The method of claim 8, wherein the step b14) of calculation of an optimal linear projector (28) is implemented by an estimator of the minimum variance distortionless response, MVDR, beamforming type.

10. The method of claim 9, wherein the step b13) of estimating the transfer function of the acoustic channels (30) is implemented by an linear prediction adaptive filter (36, 38, 40), of the Least Mean Square, LMS, type, with a modulation (42) by the speech presence probability.

11. The method of claim 10, wherein said modulation by the speech presence probability is a modulation by variation of the iteration pitch of the LMS adaptive filter.

12. The method of claim 1, wherein, for the denoising of the low frequency part of step b2), the prediction of the noise from one sensor to the other may be operated in the time domain.

13. The method of claim 12, wherein the prediction of the noise from one sensor to the other is implemented by a filter (44, 46, 48) of the Speech Distortion Weighting Multi-channel Wiener Filter, SDW-MWF, type.

14. The method of claim 13, wherein the SDW-MWF filter is adaptively estimated by a gradient descending algorithm.

* * * * *